US007141360B2

(12) United States Patent
Kasperchik et al.

(10) Patent No.: US 7,141,360 B2
(45) **Date of Patent: *Nov. 28, 2006**

(54) COMPOSITIONS, SYSTEMS, AND METHODS FOR IMAGING

(75) Inventors: Vladek Kasperchik, Corvallis, OR (US); Jayprakash C. Bhatt, Corvallis, OR (US); Cari L Dorsh, McMinnville, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/864,016

(22) Filed: Jun. 9, 2004

(65) Prior Publication Data

US 2005/0277070 A1 Dec. 15, 2005

Related U.S. Application Data

(63) Continuation-in-part of application No. 10/351,188, filed on Jan. 24, 2003, now Pat. No. 6,974,661.

(51) Int. Cl.

| | |
|---|---|
| ***G03C 1/73*** | (2006.01) |
| ***G03C 1/74*** | (2006.01) |
| ***B41M 5/30*** | (2006.01) |

(52) U.S. Cl. ..... 430/343; 430/332; 430/338; 430/340; 430/964; 503/214; 503/216; 503/226

(58) Field of Classification Search ..... 430/332, 430/333, 338, 340, 343, 964; 503/214, 226, 503/216

See application file for complete search history.

(56) References Cited

U.S. PATENT DOCUMENTS

| | | | | |
|---|---|---|---|---|
| 4,339,492 | A * | 7/1982 | Mino et al. | 503/217 |
| 6,974,661 | B1 * | 12/2005 | Gore et al. | 430/343 |
| 2003/0036478 | A1 * | 2/2003 | Seki et al. | 503/217 |
| 2004/0043902 | A1 * | 3/2004 | Oda et al. | 503/218 |
| 2004/0146812 | A1 | 7/2004 | Gore et al. | |

* cited by examiner

*Primary Examiner*—Richard L. Schilling

(57) ABSTRACT

Imaging layers, image recording media, and methods of preparation of each, are provided. One exemplary embodiment of the imaging layer, among others, includes a matrix, a radiation absorbing compound dissolved in the matrix, at least two activators substantially dissolved in the matrix, and a color former. The activators can include a primary activator having a higher acidity than a secondary activator. In addition, the primary activator has a lower solubility in the matrix than the secondary activator. The color former is substantially insoluble in the matrix at ambient conditions and is substantially uniformly distributed in the matrix.

23 Claims, 2 Drawing Sheets

COMPOSITIONS, SYSTEMS, AND METHODS FOR IMAGING

CROSS-REFERENCE TO RELATED APPLICATION/CLAIM OF PRIORITY

This application is a continuation-in-part of and claims priority to U.S. Utility Application entitled, "COMPOSITIONS, SYSTEMS, AND METHODS FOR IMAGING," having patent application Ser. No. 10/351,188, now U.S. Pat. No. 6,974,661, filed Jan. 24, 2003, which is entirely incorporated herein by reference.

BACKGROUND

Materials that produce color change upon stimulation with energy such as light or heat may have possible applications in imaging. For example, such materials may be found in thermal printing papers and instant imaging films. Generally, the materials and compositions known so far may require a multifilm structure and further processing to produce an image (e.g., instant imaging films such as Polaroid). And in the case of facsimile and thermal head media, high energy input of greater than 1 J/cm$^2$ is needed to achieve good images. The compositions in multifilm media may require control of diffusion of color-forming chemistry and further processing, and are in separate phases and layers. Most thermal and facsimile paper coatings consist of coatings prepared by preparing fine dispersions of more than two components. The components mix and react upon application of energy, resulting in a colored material. To the necessary mixing, the particles need to contact across three or more phases or layers (e.g., in a thermochromic system the reactive components are separated by the barrier phase) and merge into a new phase. Because of these multiple phases and layers, high energy is required to perform this process. For example, a relatively powerful carbon dioxide laser with an energy density of 3 J/cm$^2$ at times of much greater than 100 μs may be needed to produce a mark. In some instances, this high energy application may cause damage to the imaging substrate. In many situations, it may be desirable to produce a visible mark more efficiently using either a less intense, less powerful, and/or shorter energy application. Therefore, there is a need for fast marking coatings, possibly composed of fewer than three phases and in single layer.

SUMMARY

Briefly described, embodiments of this disclosure include imaging layers, image recording media, and methods of preparation of each. One exemplary embodiment of the imaging layer, among others, includes a matrix, a radiation absorbing compound dissolved in the matrix, at least two activators substantially dissolved in the matrix, and a color former. The activators can include a primary activator having a higher acidity than a secondary activator. In addition, the primary activator has a lower solubility in the matrix than the secondary activator. The color former is substantially insoluble in the matrix at ambient conditions and is substantially uniformly distributed in the matrix.

One exemplary embodiment of the image recording media, among others, includes a substrate having a two-phase layer disposed thereon. The two-phase layer includes a matrix, a radiation absorbing compound dissolved in the matrix, at least two activators substantially dissolved in the matrix, and a color former. The activator can include a primary activator that is a highly acidic phenol compound and a secondary activator that is a low acidic phenol compound. The color former is substantially insoluble in the matrix at ambient conditions and is substantially uniformly distributed in the matrix.

One exemplary embodiment of the method for preparing an imaging material, among others, includes, providing a matrix, a radiation absorbing compound, a color former, and at least one activator, wherein the activator includes a primary activator and a secondary activator, wherein the primary activator has a lower solubility in the matrix than the secondary activator; dissolving the radiation absorbing compound, the primary activator, and the secondary activator, substantially in the matrix; and distributing the color former substantially uniformly in the matrix, wherein the color former is substantially insoluble in the matrix at ambient conditions.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Embodiments of the disclosure include two-phase layers, methods of making the two-phase layers, and methods of using the two-phase layers. The two-phase layer includes two or more activator compounds substantially dissolved in a matrix material (hereinafter "matrix") to produce high contrast images. Using a primary activator that is a highly acidic phenol compound and a secondary activator that is a low acidic phenol compound in the two-phase layer increases the acidity in the two-phase layer which enables darker marks to be formed while also not causing significant background darkening. The two-phase layer can be a coating disposed onto a substrate and used in structures such as, but not limited to, paper media, digital recording media, and the like.

In addition, a color former is substantially insoluble in the matrix. A clear mark and excellent image quality can be obtained by directing radiation energy (e.g., a 780 nm laser operating at 45 MW) at areas of the two-phase layer. In an illustrative example the components used to produce the mark via a color change upon stimulation by energy can include a color former (e.g., a fluoran leuco dye) dispersed in the matrix as separate phase and two activators (e.g., a highly acidic phenol compound and a lower acidity phenol compound) dissolved in a matrix such as a radiation-cured acrylate polymer.

In particular embodiments, the color former is substantially insoluble in the matrix at ambient conditions, while the activators are substantially soluble in the matrix. A radiation energy absorber (e.g., an antenna) is also present in the two-phase layer. The radiation energy absorber functions to absorb energy, convert the energy into heat, and deliver the heat to the reactants. The energy may then be applied by the way of an infrared laser. Upon application of the energy, both the activators and the color-former may become heated (e.g., solubilizing the color former) and mix, which causes the color-former to become activated and cause a mark (color) to be produced. The use of the highly acidic phenol activator in conjunction with the low acidic phenol activator provides enough acidity to produce dark marks. In addition, the total content of aromatic phenols in the matrix phase is low enough to not substantially solubilize the color former (e.g., leuco dyes) and cause background darkening.

Figure 1:
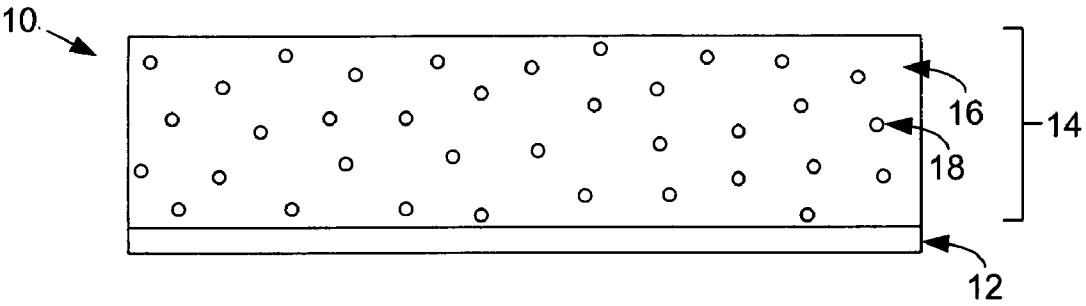
FIG. 1 illustrates an illustrative embodiment of the imaging medium.

FIG. 1 illustrates an embodiment of an imaging medium 10. The imaging medium 10 can include, but is not limited to, a substrate 12 and a two-phase layer 14. The substrate 12 may be a substrate upon which it is desirable to make a mark, such as, but not limited to, paper media (e.g., labels, tickets, receipts, or stationary), overhead transparencies, a metal/metal composite, glass, a ceramic, a polymer, digital audio media (e.g., a compact disk (CD) (e.g., CD-R/RW/ROM), and digital video media (DVD) (e.g., DVD-R/RW/ROM).

The two-phase layer 14 can include, but is not limited to, a matrix 16, at least two activators (e.g., a highly acidic phenol activator and a lower acidity phenol activator), a radiation absorbing compound, and a color former.

The activators and the color former, when mixed upon heating (e.g., both are substantially dissolved in the matrix 16), may change color to form a mark. The activators and the radiation absorbing compound are substantially soluble in the matrix 16. The color former is substantially insoluble in the matrix 16 and may be suspended in the matrix 16 as substantially uniformly distributed insoluble particles 18.

The two-phase layer 14 may be applied to the substrate 12 via any acceptable method, such as, but not limited to, rolling, spraying, and screen-printing. In addition, one or more layers can be formed between the two-phase layer 14 and the substrate 12 and/or one or more layers can be formed on top of the two-phase layer 14. In one embodiment, the two-phase layer 14 is part of a CD or a DVD.

To form a mark, radiation energy is directed imagewise at one or more discrete areas of the two-phase layer 14 of the imaging medium 10. The form of radiation energy may vary depending upon the equipment available, ambient conditions, the desired result, and the like. The radiation energy can include, but is not limited to, infrared (IR) radiation, ultraviolet (UV) radiation, x-rays, and visible light. The radiation absorbing compound absorbs the radiation energy and heats the area of the two-phase layer 14 to which the radiation energy impacts. The heat may cause suspended insoluble particles 18 to reach a temperature sufficient to cause the melting and subsequent diffusion into the matrix phase of the color former initially present in the insoluble particles 18 (e.g., glass transition temperatures ($T_g$) or melting temperatures ($T_m$) of insoluble particles 18 and matrix). Apart from melting the matrix 16, heat also reduces the matrixes 16 melt viscosity, and accelerates the diffusion rate of the color-forming components (e.g., leuco-dye and activators), thus speeding up the color formation rate. The activators and color former may then react to form a mark (color) on certain areas of the two-phase layer 14.

Figure 2:
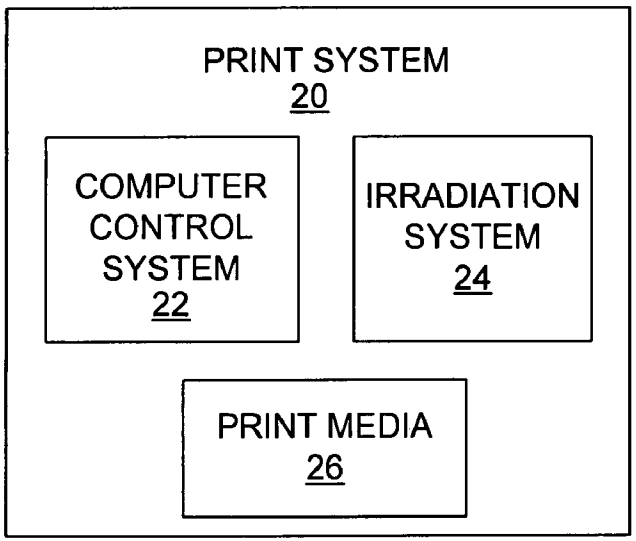
FIG. 2 illustrates a representative embodiment of a printer system.

FIG. 2 illustrates a representative embodiment of a print system 20. The print system 20 can include, but is not limited to, a computer control system 22, an irradiation system 24, and print media 26 (e.g., imaging media). The computer control system 22 is operative to control the irradiation system 24 to cause marks (e.g., printing of characters, symbols, photos, and the like) to be formed on the print media 26. The irradiation system 24 can include, but is not limited to, a laser system, UV energy system, IR energy system, visible energy system, x-ray system, and other systems that can produce radiation energy to cause a mark to be formed on the two-phase layer 14. The print system 20 can include, but is not limited to, a laser printer system and a ink-jet printer system. In addition, the print system 20 can be incorporated into a digital media system. For example, the print system 20 can be operated in a digital media system to print labels (e.g., the two-phase layer is incorporated into a label) onto digital media such as CDs and DVDs. Furthermore, the print system 20 can be operated in a digital media system to directly print onto the digital media (e.g., the two-phase layer is incorporated in the structure of the digital media).

The matrix 16 can include compounds capable of and suitable for dissolving and/or dispersing the radiation absorbing compound, and the activators at ambient conditions. The matrix 16 can include, but is not limited to, UV curable monomers, oligomers, and pre-polymers (e.g., acrylate derivatives). Illustrative examples of UV-curable monomers, oligomers, and pre-polymers (that may be mixed to form a suitable UV-curable matrix) can include, but are not limited to, hexamethylene diacrylate, tripropylene glycol diacrylate, lauryl acrylate, isodecyl acrylate, neopentyl glycol diacrylate, 2-phenoxyethyl acrylate, 2(2-ethoxy)ethylacrylate, polyethylene glycol diacrylate and other acrylated polyols, trimethylolpropane triacrylate, pentaerythritol tetraacrylate, ethoxylated bisphenol A diacrylate, acrylic oligomers with epoxy functionality, and the like.

In an embodiment the matrix 16 is used in combination with a photo package. A photo package may include, but is not limited to, a light absorbing species, which initiates reactions for curing of a matrix such as, by way of example, benzophenone derivatives. Other examples of photoinitiators for free radical polymerization monomers and prepolymers include, but are not limited to, thioxanethone derivatives, anthraquinone derivatives, acetophenones and benzoine ether types, and the like.

It may be desirable to choose a matrix 16 that is cured by a form of radiation other than the type of radiation that causes a color change. Matrices 16 based on cationic polymerization resins may include photo-initiators based on aromatic diazonium salts, aromatic halonium salts, aromatic sulfonium salts and metallocene compounds, for example. An example of the matrix 16 may include Nor-Cote CDG000. Other acceptable matrices 16 may include, but is not limited to, a mixture of acrylated polyester oligomers (e.g., CN293 and CN294, available from Sartomer Co.).

The matrix compound 16 is from about 2 wt % to 98 wt % of the two-phase layer and from about 20 wt % to 90 wt % of the two-phase layer. The term "radiation absorbing compound" (e.g., an antenna) means any radiation absorbing compound in which the antenna readily absorbs a desired specific wavelength of the marking radiation. The radiation absorbing compound may be a material that effectively absorbs the type of energy to be applied to the imaging medium 10 to effect a mark or color change. The radiation absorbing compound can include, but is not limited to, IR780 (Aldrich 42,531-1) (1) (3H-Indolium, 2-[2-[2-chloro-3-[(1,3-dihydro-3,3-dimethyl-1-propyl-2H-indol-2-ylidene) ethylidene]-1-cyclohexen-1-yl]ethenyl]-3,3-dimethyl-1-propyl-, iodide (9Cl)), IR783 (Aldrich 54,329-2) (2) (2-[2-[2-Chloro-3-[2-[1,3-dihydro-3,3-dimethyl-1-(4-sulfobutyl)-2H-indol-2-ylidene]-ethylidene]-1-cyclohexen-1-yl]-ethenyl]-3,3-dimethyl-1-(4-sulfobutyl)-3H-indolium hydroxide, inner salt sodium salt), Syntec 9/1 (3)), Syntec 9/3 (4) or metal complexes (e.g., dithiolane metal complexes (5) and indoaniline metal complexes (6)) may be suitable radiation absorbing compounds:

(1)

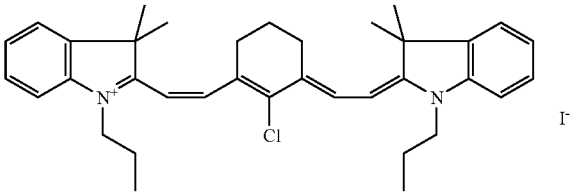

(2)

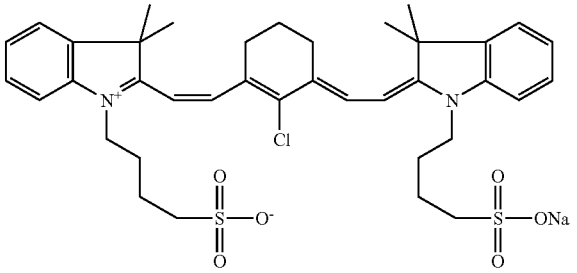

(3)

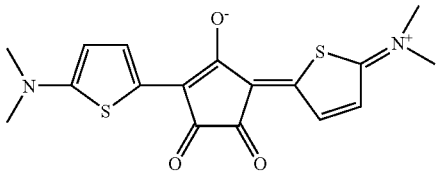

(4)

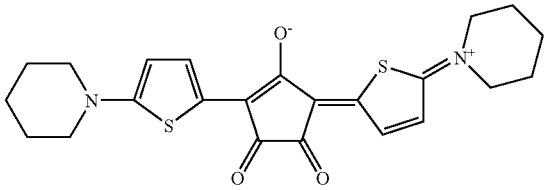

(5)

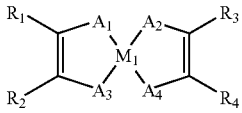

where $M_1$ is a transition metal, $R_1$, $R_2$, $R_3$, and $R_4$ are alkyl or aryl groups with or without halo substituents, and $A_1$, $A_2$, $A_3$, and $A_4$ can be S, NH, or Se;

(6)

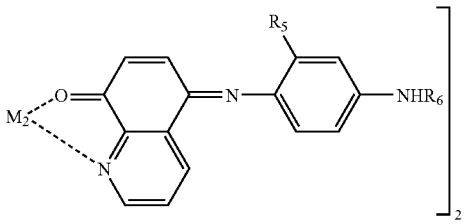

where $M_2$ is Ni or Cu and $R_5$ and $R_6$ are aryl or alkyl groups with or without halo substituents.

Additional examples of radiation absorbing compounds can be found in "Infrared Absorbing Dyes", Matsuoka, Masaru, ed., Plenum Press (1990) (ISBN 0-306-43478-4) and "Near-infrared Dyes for High Technology Applications", Daehne, S.; Resch-Genger, U.; Wolfbeis, O., Ed., Kluwer Academic Publishers (ISBN 0-7923-5101-0), both incorporated herein by reference.

The radiation absorbing compound is from about 0.01 wt % to 10 wt % of the two-phase layer and from about 0.1 wt % to 3 wt % of the two-phase layer.

As used herein, the term "activator" is a substance that reacts with a color former and causing the color former to alter its chemical structure and change or acquire color. In general, the greater the concentration of the activator the higher the acidity of the of the matrix 16, the darker the mark formed upon heating. However, the increased concentration of the activator in the matrix causes the color former to unintentionally and prematurely dissolve in the matrix causing a darker background. Therefore, a lower contrast between the mark and the background is produced by increasing the concentration of a single activator. Another limitation is that highly acidic activators have a low solubility in the matrix 16, so the amount of the activator that can be added to the matrix 16 and is soluble is limited.

To produce a greater contrast between the mark and the background, at least two activators are included in the matrix of the two-phase layer. The two activators are substantially soluble in the matrix 16. In an embodiment, the two-phase layer includes a primary activator that is a highly acidic phenol compound and a secondary activator that is a low acidic phenol compound relative to the highly acidic phenol compound. The primary activator has a lower solubility in the matrix 16 than the secondary activator.

In general, the primary activator is present in the matrix 16 at levels close to its solubility limit. However, it should be noted that the primary activator can be present at concentrations higher than the solubility limit but it is expected that the undissolved primary activator does not contribute significantly to color-forming interactions. In an embodiment, the secondary activator is used at a higher concentration than the primary activator since the secondary activator has a higher solubility in the matrix 16, however, the secondary activator can be used in lower concentrations for other embodiments. In particular, the primary activator is from about 0.1 wt % to 15 wt %, about 0.3 wt % to 12 wt % of the two-phase layer, and about 1 wt % to 12 wt % of the two-phase layer. The secondary activator is from about 0.1 wt % to 25 wt %, about 0.2 wt % to about 20 wt %, and about 1 wt % to 20 wt % of the two-phase layer.

In general, the primary activator has a higher acidity and/or a greater number of acidic groups per molecule than the secondary activator. The primary activator is selected from compounds having a pKa of less than 8.0 and in some embodiments having two or more acidic groups per molecule, while the secondary activator is selected from compounds having a pKa of greater than than that of the primary activator and/or, in some embodiments has one acidic group per molecule. It should be noted that the primary activator of one formulation could be used as a secondary activator in another formulation.

Exemplary embodiments of the primary activator include, but are not limited to, 4-hydroxyphenyl sulfone, 2,4'-dihydroxydiphenyl sulfone, Bis(4-hydroxy-3-allylphenyl)sulfone, 2,2',5,5'-Tetrahydroxy diphenyl sulfone, and combinations thereof. Exemplary embodiments of the secondary activator include, but are not limited to, 4-hydroxyphenyl-4'-isopropoxyphenly sulfone, 2,2-Bis(4-hydroxyphenyl)propane, and combinations thereof.

In one embodiment the primary activator is 4-hydroxyphenyl sulfone (pKa=6.43) and it has a relatively lower solubility in the matrix, while the secondary activator is Bis(4-hydroxy-3-allylphenyl)sulfone (pKa=7.22) and it has a relatively higher solubility in the matrix. In another example, the primary activator is Bis(4-hydroxy-3-allylphenyl)sulfone (pKa=7.22) and it has a relatively lower solubility in the matrix, while the secondary activator is Bisphenol A (pKa=9.73) and it has a relatively higher solubility in the matrix.

The term "color former" is a color forming substance, which is colorless or one color in a non-activated state and produces or changes color in an activated state. The color former can include, but is not limited to, leuco dyes and phthalide color formers (e.g., fluoran leuco dyes and phthalide color formers as described in "The Chemistry and Applications of Leuco Dyes", Muthyala, Ramiah, ed., Plenum Press (1997) (ISBN 0-306-45459-9), incorporated herein by reference). Examples of fluoran leuco dyes include the structure shown in Formula (10)

(10)

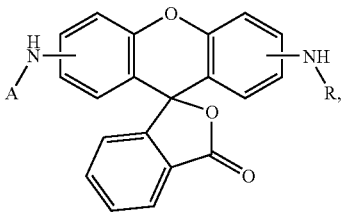

where A and R are aryl or alkyl groups. The color former is from about 1 wt % to 80 wt % of the two-phase layer and from about 5 wt % to 50 wt % of the two-phase layer.

The activators and the color former (e.g., BK-400) act in tandem to produce a mark. The activators and color former may be three or more substances that when reacted together produce a color change. When reacted, the activators may initiate a color change in the color former or develop the color former.

By "substantially insoluble," it is meant that the solubility of the color-former in the matrix at ambient conditions is so low, that no or very little color change may occur due to reaction of the color former and the activators at ambient conditions.

By "substantially soluble," it is meant that the solubility of the activator in the matrix at ambient conditions is high, that all or most of the activator present in the two-phase layer is dissolved in the matrix.

Although, in the embodiments described above, the activators may be dissolved in the matirx and the color former remains suspended as a substantially insoluble particle in the matrix at ambient conditions, it is also acceptable that the color former may be dissolved in the matrix and the activators may remain as a substantially insoluble particle at ambient conditions.

Figure 3:
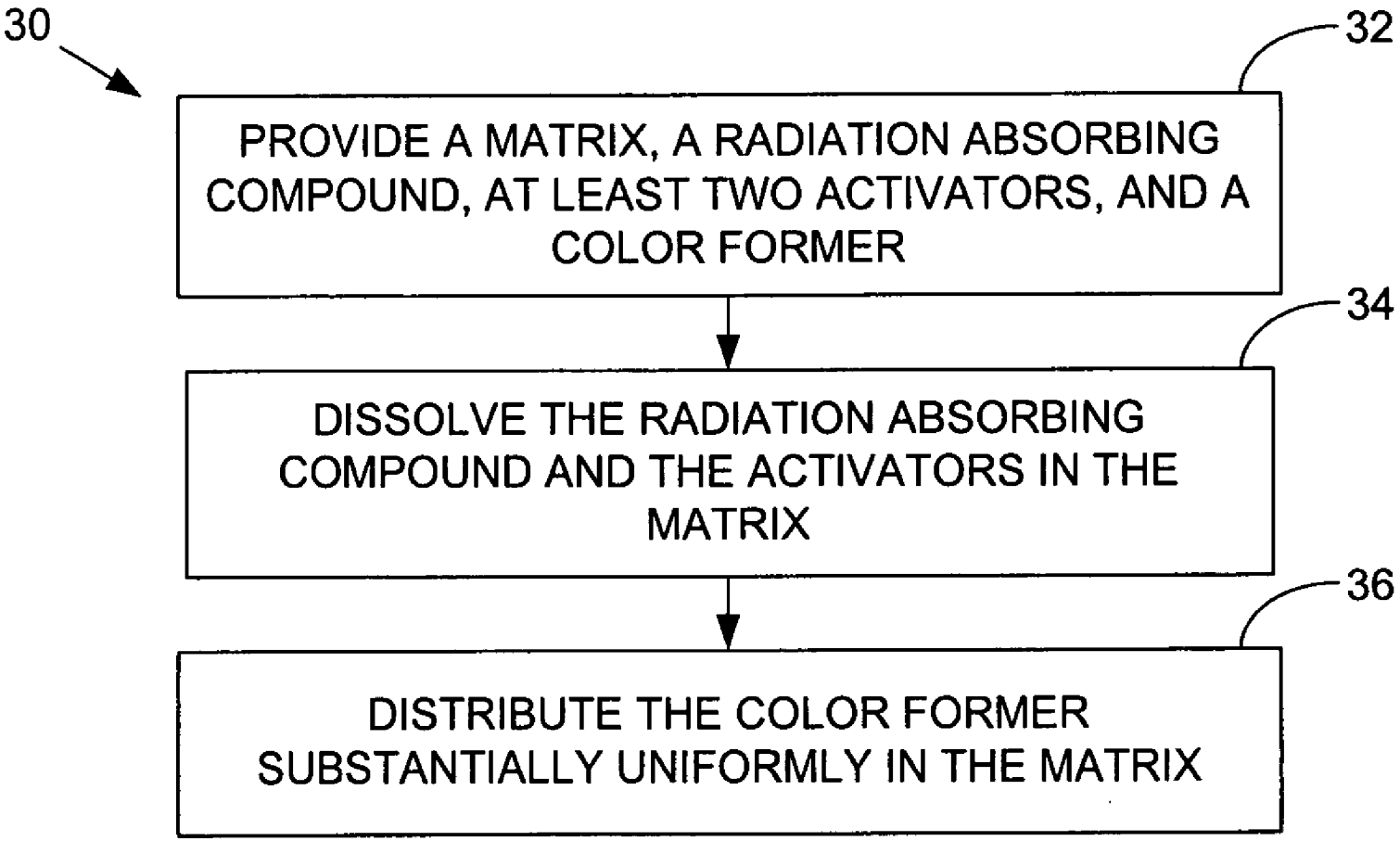
FIG. 3 illustrates a representative process for making an embodiment of a two-phase layer.

FIG. 3 illustrates a representative process 30 for making the two-phase layer 14. In block 32, the matrix, the radiation absorbing compound, the activators, and the color former, are provided. In block 34, the radiation absorbing compound and the activators are dissolved in the matrix. The color former is substantially insoluble in the matrix at ambient conditions. In block 36, the color former is distributed substantially uniformly in the matrix. Subsequently, the two-phase layer 14 can be disposed on a substrate 12 to form the imaging medium 10.

EXAMPLE 1

About 87 grams of an activator D8 (4-hydroxyphenyl-4'-isopropoxyphenyl sulfone) was melted in a beaker. About 13 grams of an antenna dye IR780 was dissolved in the melted D8 while the temperature of the melt was raised to about 150–160° C. The activator/antenna alloy was cooled and ground into a fine powder.

About 7 grams of the ground secondary activator(D8)/antenna alloy powder and about 3.7 g of 4,4-dihydroxydiphenyl sulfone (primary activator) were dissolved in 49 g Nor-Cote CDG000 UV-lacquer (i.e., a mixture of UV-curable acrylate monomers and oligomers) to form the lacquer/antenna/activator solution.

About 10 grams of m-terphenyl (accelerator) was melted in a beaker. The melt was heated to about 110° C. About one hundred grams of BK400 was added in small increments to the melt upon constant stirring. The added BK400 is a leuco-dye (2'-anilino-3'-methyl-6'-(dibutylamino)fluoran) available from Nagase Corporation, the structure of which is set forth below as Formula 11:

(11)

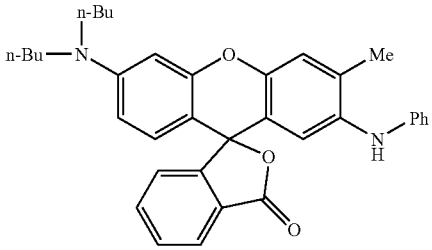

The temperature of the mixture was increased up to about 170 to180° C. Stirring was continued until complete dissolution of BK400 in the melt (usually takes about 10–15 min) was obtained to form an accelerator/leuco-dye solution. About 550 mg of IR780 (IR dye) was added to the melt upon constant stirring. IR780 iodide, also known as 3H-Indolinium, 2-[2-chloro-3-[91,3-dihydro3,3-dimethyl-1-propyl-2H-indol-2-ylidene)ethylidene]-1-cyclohexen-1yl]ethenenyl]-3,3-dimethyl-1-propyl-, iodide(9Cl), has the following formula:

(12)

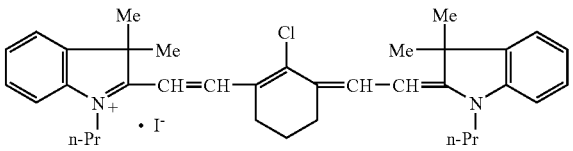

Heating and stirring was continued for about two to three additional minutes until the IR dye was completely dissolved in the melt to form a leuco-dye/antenna/accelerator alloy (eutectic). The temperature of the leuco-dye/antenna/accelerator alloy was kept to below about 190° C.

The leuco-dye/antenna/accelerator alloy was then poured into a pre-cooled freezer tray lined with aluminum foil. The solidified melt was milled into a coarse powder and then attrition-ground in the aqueous dispersion until the average volume-weighted particle size of the ground alloy was less than about 2 μm. The ground alloy was dried in a vacuum to form a leuco-dye eutectic powder.

The mixture of leuco-dye/antenna/accelerator alloy and lacquer/antenna/activator solution was formed into a UV-curable paste (about 31 g of finely milled leuco-dye/antenna/accelerator alloy per about 60 g of lacquer/antenna/activator solution) and screen printed onto a substrate at a thickness of approximately about 5 to 9 μm to form an imaging medium. The coating on the medium was then UV cured by mercury lamp.

Direct marking was effected on the resulting coated substrate with a 45 mW laser. A mark of approximately 20 μm×45 μm was produced with duration of energy applications of about 30 μsec tol 150 μsec. Direct marking occurs when the desired image is marked on the imaging medium, without the use of a printing intermediary.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. An imaging layer comprising:

a matrix;

a radiation absorbing compound dissolved in the matrix;

at least two activators substantially dissolved in the matrix, wherein a primary activator has a higher acidity than a secondary activator, and wherein the primary activator has a lower solubility in the matrix than the secondary activator; and a color former that is substantially insoluble in the matrix at ambient conditions and is substantially uniformly distributed in the matrix.

2. The imaging layer of claim 1, wherein the primary activator is from about 0.1 wt % to 15 wt % of the two-phase layer, and wherein the secondary activator is from about 0.1 wt % to about 25 wt % of the two-phase layer.

3. The imaging layer of claim 2, wherein the primary activator is selected from compounds having a pKa of less than 8, and wherein the secondary activator is selected from compounds having a pKa greater than the primary activator.

4. The imaging layer of claim 1, wherein the primary activator is selected from compounds having a pKa of less than 8, and wherein the secondary activator is selected from compounds having a pKa greater than the primary activator.

5. The imaging layer of claim 1, wherein a primary activator is a highly acidic phenol compound and a secondary activator is a low acidic phenol compound.

6. The imaging layer of claim 1, wherein the primary activator is selected from 4-hydroxyphenyl sulfone, 2,4'-dihydroxydiphenyl sulfone, Bis(4-hydroxy-3-allylphenyl) sulfone and 2,2',5,5'-tetrahydroxy diphenyl sulfone and wherein the secondary activator is selected from 4-hydroxyphenyl-4'-isopropoxyphenyl sulfone and 2,2-Bis(4-hydroxyphenyl)propane.

7. The imaging layer of claim 6, wherein the primary activator is from about 0.1 wt % to 15 wt % of the two-phase layer, arid wherein the secondary activator is from about 0.1 wt % to about 25 wt % of the two-phase layer.

8. The imaging layer of claim 1 wherein the color former comprises at least one compound is selected from a leuco dye and a phthalide dye.

9. The imaging layer of claim 1 wherein the matrix is selected from an ultraviolet curable monomers, ultraviolet oligomers, pre-polymers of ultraviolet polymers, and combinations thereof.

10. The imaging layer of claim 1 wherein the a radiation absorbing compound comprises at least one of the compounds chosen from the group consisting of quinone, phthalocyanine, naphthalocyanine, metal complexes, azo, croconium, squarilium dyes, hexafunctional polyester oligomers, and the compounds represented by the following formulae:

(A)

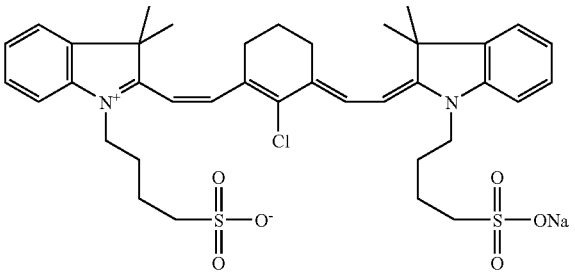

(B)

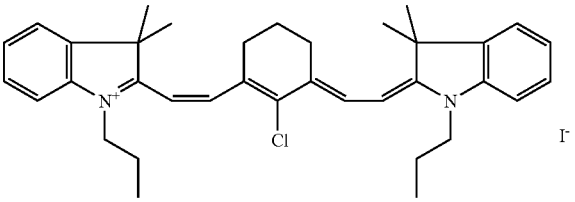

(C)

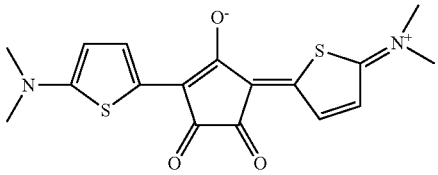

(D)

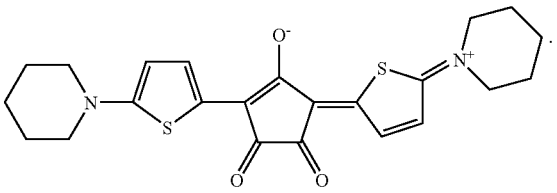

11. An image recording medium comprising:

a substrate having a two-phase layer disposed thereon, wherein the two-phase layer includes:

a matrix, a radiation absorbing compound dissolved in the matrix, at least two activators substantially dissolved in the matrix, wherein a primary activator is a highly acidic phenol compound and a secondary activator is a low acidic phenol compound, and a color former that is substantially insoluble in the matrix at ambient conditions and is substantially uniformly distributed in the matrix.

12. The image recording medium of claim 11, wherein the substrate is selected from a paper medium, a transparency, a compact disk (CD), and a digital video disk (DVD).

13. The image recording medium of claim 11, wherein the substrate is selected from a CD-R/RW/ROM and DVD-R/RW/ROM.

14. The image recording medium of claim 11, wherein the primary activator has at least one of a characteristic selected from a higher acidity than the second activator and more acidic groups per molecule than the secondary activator.

15. The image recording medium of claim 11, wherein the primary activator has a lower solubility in the matrix than the secondary activator, wherein the primary activator has a pKa of less than 8, and wherein the secondary activator has a pKa greater than the primary activator.

16. The image recording medium of claim 11, wherein the primary activator is selected from 4-hydroxyphenyl sulfone, 2,4'-dihydroxydiphenyl sulfone, Bis(4-hydroxy-3-allylphenyl) sulfone and 2,2',5,5'-tetrahydroxy diphenyl sulfone and wherein the secondary activator is selected from 4-hydroxyphenyl-4'-isopropoxyphenyl sulfone and 2,2-Bis(4-hydroxyphenyl)propane.

17. The image recording medium of claim 11, wherein the primary activator is from about 0.1 wt % to 15 wt % of the two-phase layer, and wherein the secondary activator is from about 0.1 wt % to about 25 wt % of the two-phase layer.

18. A method for preparing an imaging material, the method comprising:

providing a matrix, a radiation absorbing compound, a color former, and at least one activator, wherein the activator includes a primary activator and a secondary activator, wherein the primary activator has a lower solubility in the matrix than the secondary activator;

dissolving the radiation absorbing compound, the primary activator, and the secondary activator, substantially in the matrix; and distributing the color former substantially uniformly in the matrix, wherein the color former is substantially insoluble in the matrix at ambient conditions.

19. The method of claim 18, further comprising:

disposing the direct imaging material onto a substrate, wherein the substrate is selected from a paper media, a transparency, a compact disk (CD), and a digital video disk (DVD).

20. The method of claim 18, wherein the primary activator is from about 0.1 wt % to 15 wt % of the two-phase layer, and wherein the secondary activator is from about 0.1 wt % to about 25 wt % of the two-phase layer.

21. The method of claim 17, wherein the primary activator is selected from 4-hydroxyphenyl sulfone, 2,4'-dihydroxydiphenyl sulfone, and Bis(4-hydroxy-3-allylphenyl) sulfone and 2,2'5,5'-tetrahydroxy diphenyl sulfone and wherein the secondary activator is selected from 4-hydroxyphenyl-4'-isopropoxyphenyl sulfone and 2,2-Bis(4-hydroxyphenyl) propane.

22. An image recording medium made by the method of claim 18.

23. An imaging means, the means comprising:

means for absorbing energy;

means for forming color;

at least one activator, wherein the activator includes a primary activator that is a highly acidic phenol compound and a secondary activator that is a low acidic phenol compound; and means for binding the means for absorbing energy and the primary and secondary activators, wherein the means for absorbing energy and the primary and secondary activators are substantially dissolved in the means for binding, wherein the means for forming color is substantially insoluble in the means for binding at ambient conditions, and wherein the means for forming color is substantially uniformly distributed in the means for binding.

* * * * *